US007565985B2

(12) United States Patent
Lucey

(10) Patent No.: US 7,565,985 B2
(45) Date of Patent: Jul. 28, 2009

(54) APPARATUS INCLUDING DRIPLESS BUCKET AND LINER

(76) Inventor: John P. Lucey, 19 Ring Rd., Kingston, MA (US) 02364

( * ) Notice: Subject to any disclaimer, the term of this patent is extended or adjusted under 35 U.S.C. 154(b) by 821 days.

(21) Appl. No.: 10/985,611

(22) Filed: Nov. 10, 2004

(65) Prior Publication Data

US 2006/0096989 A1 May 11, 2006

(51) Int. Cl.
*B65D 25/16* (2006.01)

(52) U.S. Cl. ..... 220/495.11; 220/23.87

(58) Field of Classification Search ..... None
See application file for complete search history.

(56) References Cited

U.S. PATENT DOCUMENTS

| | | | | |
|---|---|---|---|---|
| 1,696,240 | A | 12/1928 | Kircher, Jr. | |
| 2,601,190 | A | 6/1952 | Wells | |
| 2,885,108 | A | 5/1959 | Donoghue | |
| 3,273,746 | A | 9/1966 | Andrews, Jr. | |
| 3,693,829 | A | 9/1972 | Price | |
| 3,727,792 | A | 4/1973 | Levin | |
| 4,122,973 | A | 10/1978 | Ahern | |
| 4,316,560 | A | 2/1982 | Carter | |
| D285,778 | S | 9/1986 | Smith | |
| 4,615,456 | A | 10/1986 | Cousar | |
| 4,964,527 | A | 10/1990 | Martin | |
| 5,058,763 | A * | 10/1991 | Dickinson | 220/495.09 |
| 5,160,067 | A | 11/1992 | Luber | |
| 5,305,909 | A * | 4/1994 | Merritt | 220/579 |
| 5,913,450 | A | 6/1999 | Runkel | |
| 6,189,725 | B1 | 2/2001 | Monico | |
| 6,311,862 | B1 | 11/2001 | Barnes | |
| 6,609,629 | B2 | 8/2003 | Lucey | |
| 2002/0139807 | A1 * | 10/2002 | Lucey | 220/698 |

FOREIGN PATENT DOCUMENTS

| | | |
|---|---|---|
| DE | 29905100 U1 | 6/1999 |
| GB | 2103173 A | 2/1983 |

OTHER PUBLICATIONS

Notification Concerning Transmittal of International Preliminary Report on Patentability (1 page); International Preliminary Report on Patentability (1 page); and Written Opinion of the International Searching Authority (5 pages), for International Application No. PCT/US2005/040735; mailed on May 24, 2007.

Notification of Transmittal of the International Search Report and the Written Opinion of the International Searching Authority, or the Declaration (2 pages), International Search Report (5 pages), and Written Opinion of the International Searching Authority (5 pages) for International Application No. PCT/US2005/040735 mailed Jun. 7, 2006.

* cited by examiner

*Primary Examiner*—Stephen Castellano
(74) *Attorney, Agent, or Firm*—George A. Herbster

(57) ABSTRACT

A container having an external gutter located below a primary wiping surface or edge. Drips from the wiping surface to the exterior of the container accumulate in the gutter and drain back into the container through drain notches at the bottom of the gutter. A liner having the same basic configuration as the paint bucket can be used to cover all portions of the paint bucket thereby to minimize any need to clean the paint bucket. The liner can be disposable. A cover can seal the paint bucket with or without a liner.

7 Claims, 12 Drawing Sheets

APPARATUS INCLUDING DRIPLESS BUCKET AND LINER

BACKGROUND OF THE INVENTION

1. Field of the Invention

The present invention generally relates to containers from which a liquid is removed by pouring or by means of a utensil or tool. More particularly this invention is directed to containers or buckets used by painters in which a brush is dipped into the container and then drawn across a container rim.

2. Description of Related Art

Most painters prefer to work out of paint buckets or containers other than an original paint can for several reasons. First the original container is less likely to become fouled by paint dripping into the sealing ring. At the end of a session, the painter must clean any excess paint remaining in the sealing grooves. Otherwise the original paint can is difficult to reseal. Improper container sealing may cause paint at the surface in the original can to interact with air and form a film.

Second, a paint bucket enables a painter to portion off only the amount of material needed to complete a job. In the case of quick drying materials, only the amount that can be used within the working life of the material may be portioned off.

Third, when painting requires several gallons of paint, multiple original cans can be mixed in one large container and then returned to original containers to assure a more consistent paint color. Then the paint can be poured from the original container into a paint bucket as it is needed. Thereafter, the painter may use smaller amounts of paint in a secondary container to minimize any material spilled should the paint pail become overturned during use.

When painting, a painter dips the brush into the paint to load the bristles. Then many painters remove excess paint by scraping the bristles on the most convenient edge of a pail or attachment, this edge usually being the outermost rim or edge. Eventually paint accumulates on the rim. This paint then drips from the outer scraping edge and either falls onto whatever surface is underneath the paint bucket or runs down the exterior of the bucket to such a surface with possible damage to such a surface.

U.S. Pat. No. 6,609,629 discloses a container having an external gutter located below a primary wiping surface or edge. Drips from the wiping surface to the exterior of the container accumulate in the gutter and drain back into the container through drain holes at the bottom of the gutter.

The container as specifically disclosed in U.S. Pat. No. 6,609,629 is particularly advantageous when it is used occasionally. However, it has been found that for repeated use that this paint bucket requires cleaning after each use. Specifically, it is necessary to wipe the gutter reasonably clean in order to prevent any accumulation of dry paint from blocking the path back to the drain holes. In addition, the drain holes are formed as closed slots. These also need to be cleaned periodically to avoid clogging.

However, professional painters often do not want to take the time to clean such paint buckets. They preferred to work with a conventional paint pail or other container particularly with a disposable liner. The use of a disposable liner, as will be apparent, minimizes the cleaning operation. Adapting a liner to the structure shown in U.S. Pat. No. 6,609,629, however, it is not readily apparent because a liner to be effective, must completely cover all surfaces of the paint bucket. This is particularly difficult with closed slots.

SUMMARY

Therefore it is an object of this invention to provide a dripless paint bucket that is easy to clean for repeated uses.

Another object of this invention is to provide a dripless paint bucket that can accept a liner.

Yet another object of this invention is to provide a liner for use with a dripless paint bucket.

In accordance with one aspect of this invention, a bucket is adapted for dripless painting and facilitates cleaning for allowing the bucket to be reused. The bucket includes a container having an open top defined by a top rim, a closed bottom and a side wall. A continuous circumferential gutter is formed integrally with and exteriorly of the side wall at a location below the top rim. A drain notch extends through the side wall from the top rim toward the gutter.

In accordance with another aspect of this invention, a liner is provided for use in a paint bucket in which the paint bucket includes a container having an open top define by a top rim, a closed bottom and a side wall and a continuation circumferential gutter formed integrally with and exteriorly to the side wall at a location below the top rim and includes a bucket drain notch through the side wall extending from the top rim and opening into the gutter. The liner includes a liner container for holding paint that has open top defined by a top rim, a closed bottom and a side wall and is adapted to fit within the paint bucket container. A continuous circumferential liner gutter is formed integrally with and exteriorly of the liner side wall at a location below the liner top rim. A liner drain notch extends through the liner side wall extending from the liner top rim and opening into the liner gutter. The liner gutter and drain notches have positions and shapes for nesting the liner in the paint bucket container whereby the liner overlies the bucket top rim gutter and drain notch.

In yet another aspect of this invention, an assembly for facilitating painting comprises a paint bucket and a disposable liner. The paint bucket has a bucket container having an open top defined by a top rim, a closed bottom and a side wall. A continuous circumferential bucket gutter is formed integrally with and exteriorly of the side wall at a location below the top rim. A bucket drain notch extends through the side wall from the top rim and opening into the gutter. A handle pivotly attaches to the bucket side wall below the bucket gutter and the top rim. The disposable liner has a liner container for holding paint with an open top defined by a top rim, a closed bottom and a side wall adapted to fit within the paint bucket container. A continuous, circumferential liner gutter is formed integrally with and exteriorly of said liner side wall at a location below the liner top rim. A liner drain notch extends through the liner side wall from the liner top rim and opens into the liner gutter. The liner gutter and drain notches have positions and shapes for nesting the liner in the paint bucket container and for overlying the bucket top rim, gutter and drain notch whereby paint dripping from the top rim into the liner gutter drains through the liner drain notch into the liner container.

In accordance with yet another aspect of this invention, a molded dripless paint bucket comprises a container with a tapered side wall, a bottom closure and a top rim defining an opening into the interior of the container. A continuous circumferential gutter has a floor formed integrally with the side wall and an outer edge lying in a plane below the plane of the top rim. A pair of diametrically opposed drain notches extend through the side wall extending from the top rim to the floor whereby any paint that drips from the outside of the top rim collects in the bottom of the gutter to pass through the drain notches into the container. The floor slopes down to the drain notches from positions remote thereto thereby to direct the paint from the gutter through the drain notches into the container.

BRIEF DESCRIPTION OF THE DRAWINGS

The various objects, advantages and novel features of this invention will be more fully apparent from a reading of the following detailed description in conjunction with the accompanying drawings in which like reference numerals refer to like parts, and in which.

DESCRIPTION OF ILLUSTRATIVE EMBODIMENTS

Figure 1:
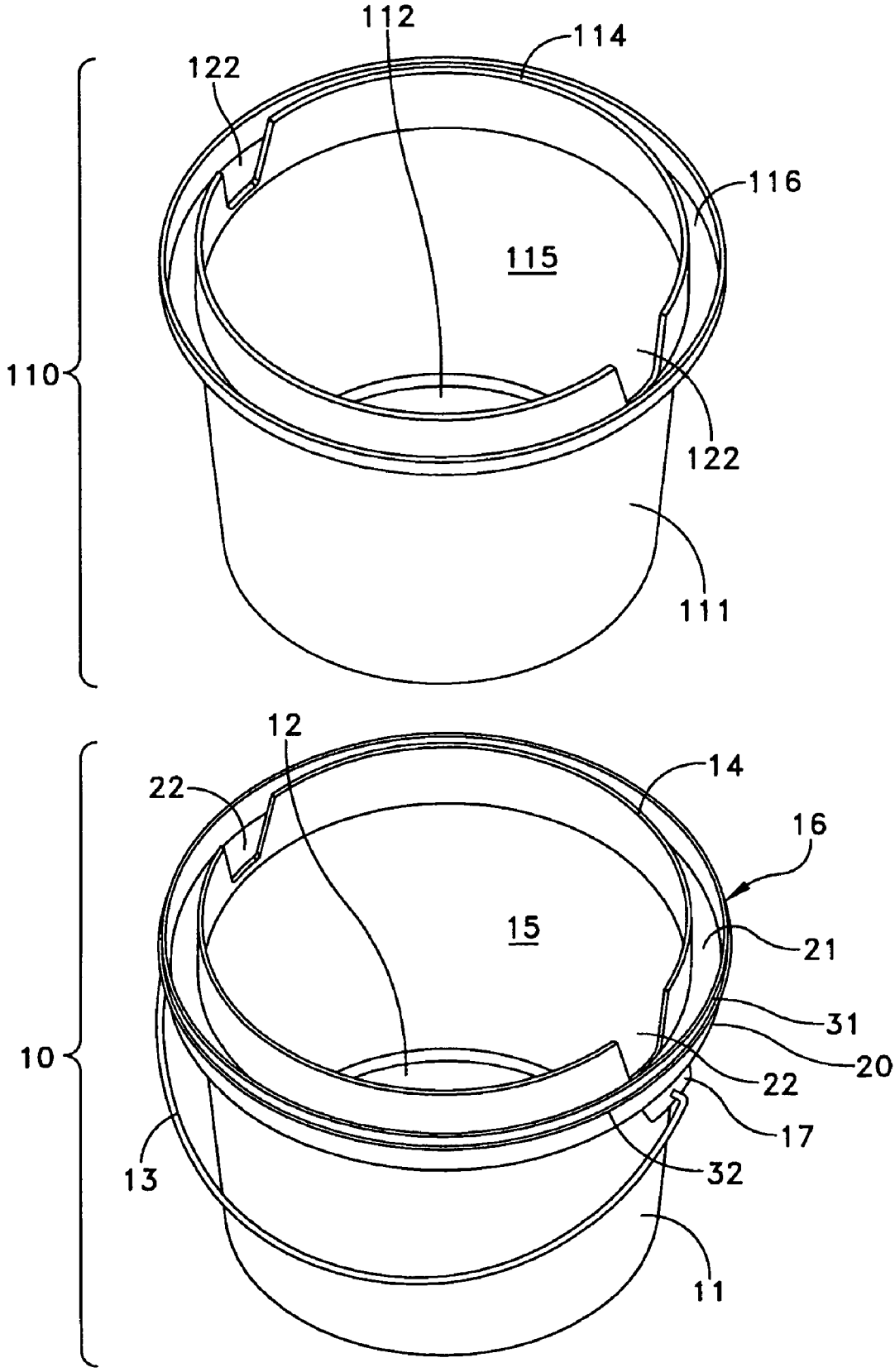
FIG. 1 is a perspective view of painting apparatus including a paint bucket and liner constructed in accordance with this invention.
Figure 2:
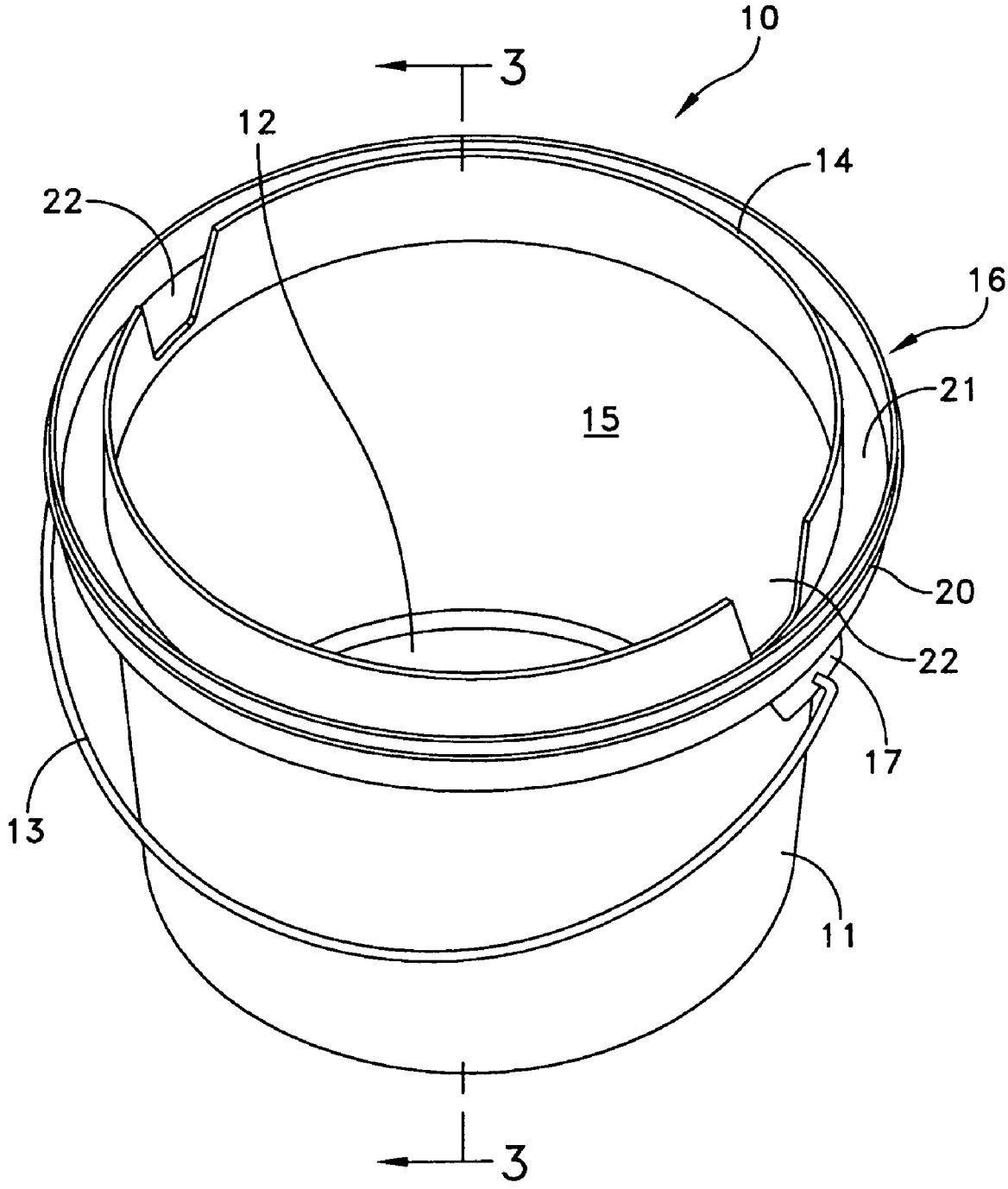
FIG. 2 is a perspective view of a paint bucket shown in FIG. 1.

FIGS. 1 and 2 show a painting apparatus of this invention including a dripless paint bucket 10 constructed in accordance with this invention comprising a molded container with a tapered, conical side wall 11, a closed bottom 12 and an optional handle 13. At the top of the paint bucket 10 a top edge or rim 14 defines an opening into an interior 15 of the paint bucket 10 that can store paint.

The paint bucket 10 has a continuous circumferential gutter 16 formed integrally with and exteriorly of the wall 11. The optional handle pivots in a oppositely disposed handle attachments, one such handle attachment 17 being shown below the gutter 16. The handle attachments 17 depend from an outer wall 20 of the gutter 16. A bottom edge or floor 21 of the gutter 16 extends radially away from the side wall 11. Oppositely disposed drain notches 22 through the side wall 11 extend downwardly to the floor 21 from the top rim 14 to provide a passage for paint from gutter 16 into the interior 15 of the paint bucket 10. In a preferred embodiment, the portion of the floor 21 midway between the drain notches 22 may be elevated so the floor promotes drainage of the paint toward the drain notches 22. In addition the floor 21 may have a conical shape to slope downward toward the side wall 11. Each of these features contributes to directing accumulated paint toward the drain notches 22 and into the interior 15.

Figure 4:
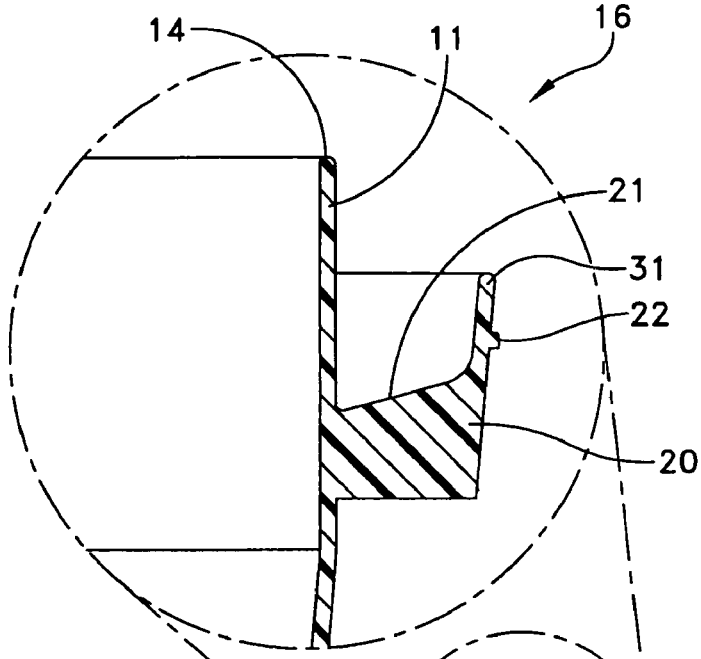
FIGS. 3 and 4 are cross sectional views of the paint bucket taken along 3-3 in FIG. 2.
Figure 3:
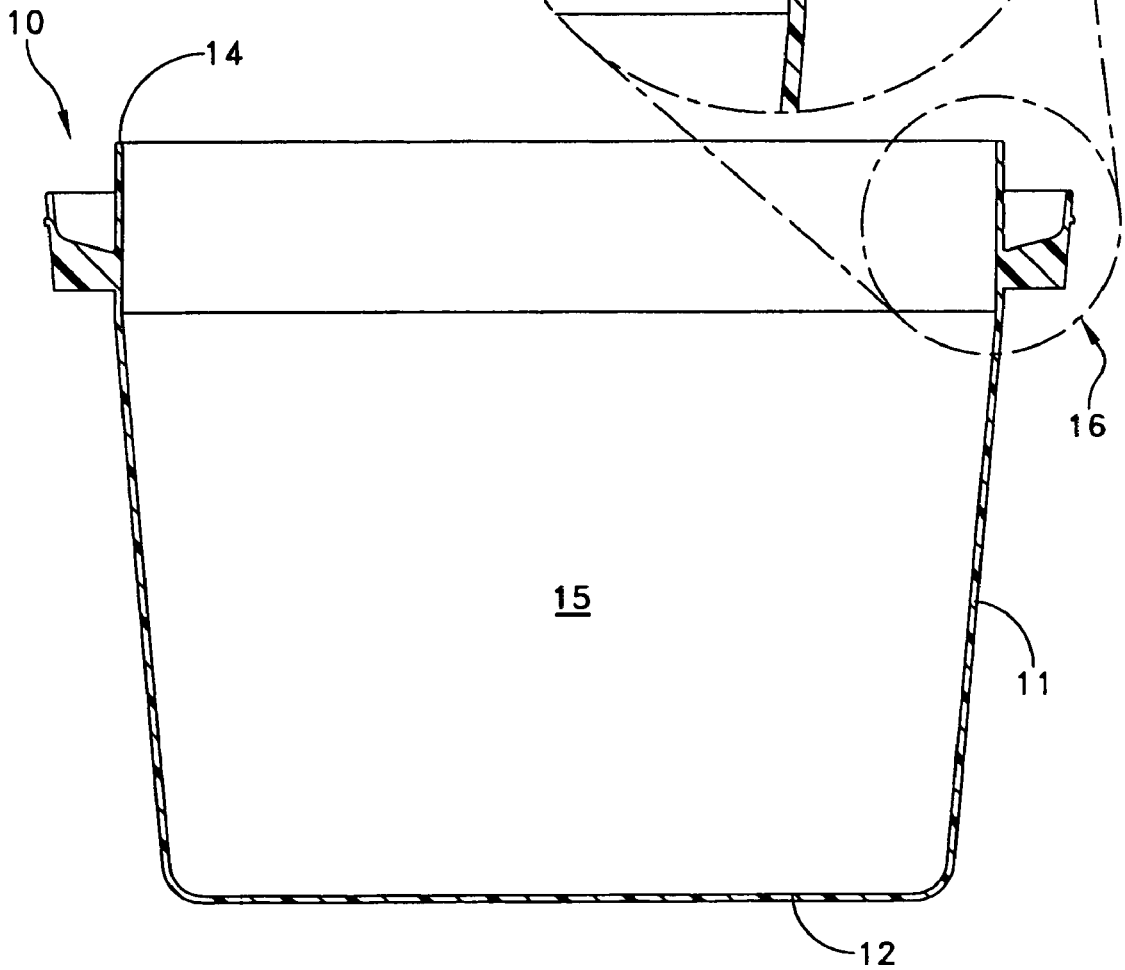

Referring now to the cross-sectional views in FIGS. 3 and 4, it will be evident that the diameter of the gutter 16 is greater than the outer diameter of the top rim 14 and that the floor 21 lies below the top rim 14 and the top of the upper outer wall 20. As a paint brush with loaded bristles is withdrawn across the top rim 14, any paint drips from the outside will collect on the gutter floor 21 and eventually pass through the drain notches 22 in FIGS. 1 and 2 into the paint bucket interior 15 protecting whatever is underneath the paint bucket 10.

Referring now to FIGS. 1 and 5 through 7, a liner 110 constructed in accordance with another aspect of this invention is adapted to be inserted into the paint bucket 10 of FIGS. 1 and 2 and cover all the surface of the paint bucket 10. More specifically, the liner 110 in FIGS. 1 and 5 through 7 is constituted by a molded container with a tapered, conical side wall 111 and a closed bottom 112. The side wall 111 extends upward to a rim 114 that circumscribes and defines an open top into the interior 115.

The liner 110 has an integral gutter structure 116 that conforms to the gutter 16 and notches 22 in FIG. 1. The gutter structure 116 is formed integrally with and exteriorly of the liner side wall 111 at a location below the liner rim 114. More specifically, and as particularly shown in FIGS. 5 through 7, the side wall has an extension 123 that extends to the top rim 114. The molded plastic forms a short annular section 124, shown as a horizontal section and then forms a depending cylindrical section 125 that extends to the bottom of the gutter 16 in FIG. 1.

Figure 5:
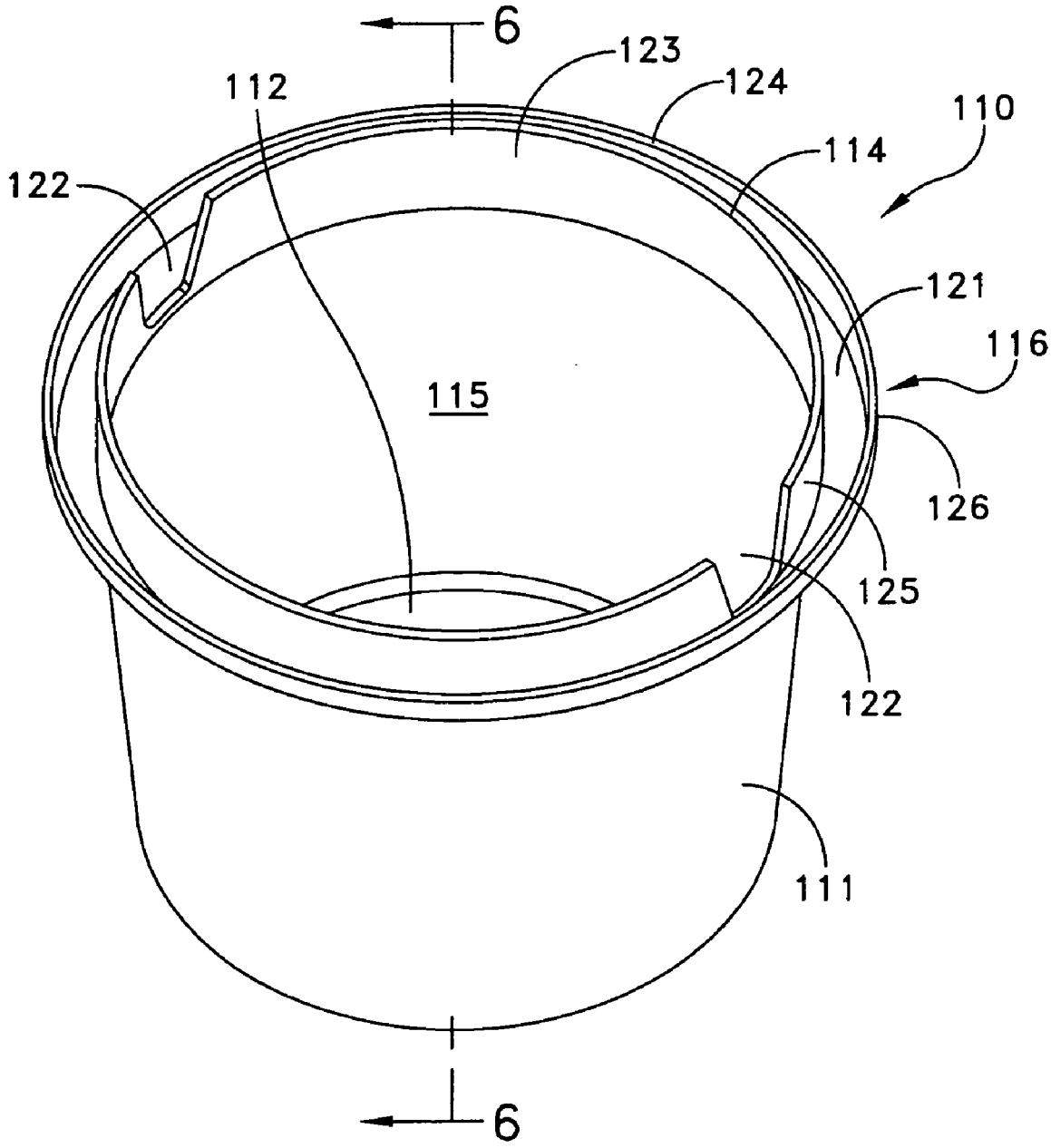
FIG. 5 is a perspective view of the liner in FIG. 1.
Figures 6, 7:
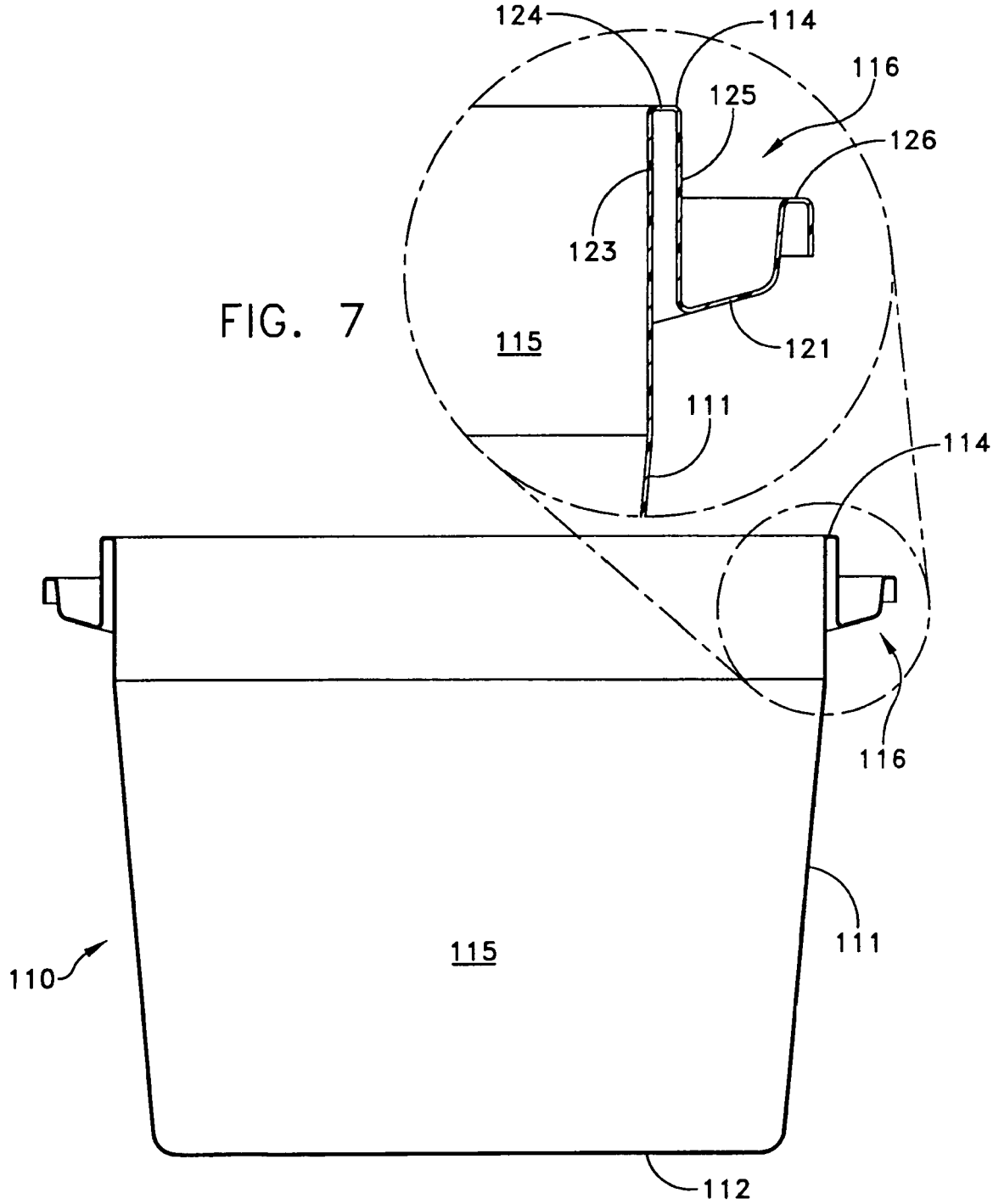
FIGS. 6 and 7 are cross sectional views of the liner shown in FIG. 5 taken along lines 6-6 in FIG. 5.

Still referring to FIGS. 5 through 7, the gutter structure includes a conical floor 121 that conforms to the floor 21 in the paint bucket 10 of FIG. 1. An inverted U-shaped portion 126 completes the gutter structure 116.

As particularly shown in FIG. 5, the extension 123 and sections 124 and 125 lie on a cylindrical path. However, there are two diametrically opposed portions where the drain notches 122 are formed. Essentially the mold for the liner 110 will include inserts or other structures for producing the drain notches 122 during the molding process. The size, slope and orientation will be selected so that the drain notches 122 in the liner 110 conform to the drain notches 22 in the paint bucket.

The paint bucket 10 effectively supports the liner 110. Consequently the liner 110 can be formed of a thinner and even pliable plastic material. This enables the liner 110 to be formed inexpensively by thermoforming or other like molding procedures. The liners can be collapsed for packaging and shipment prior to use.

Figure 8:
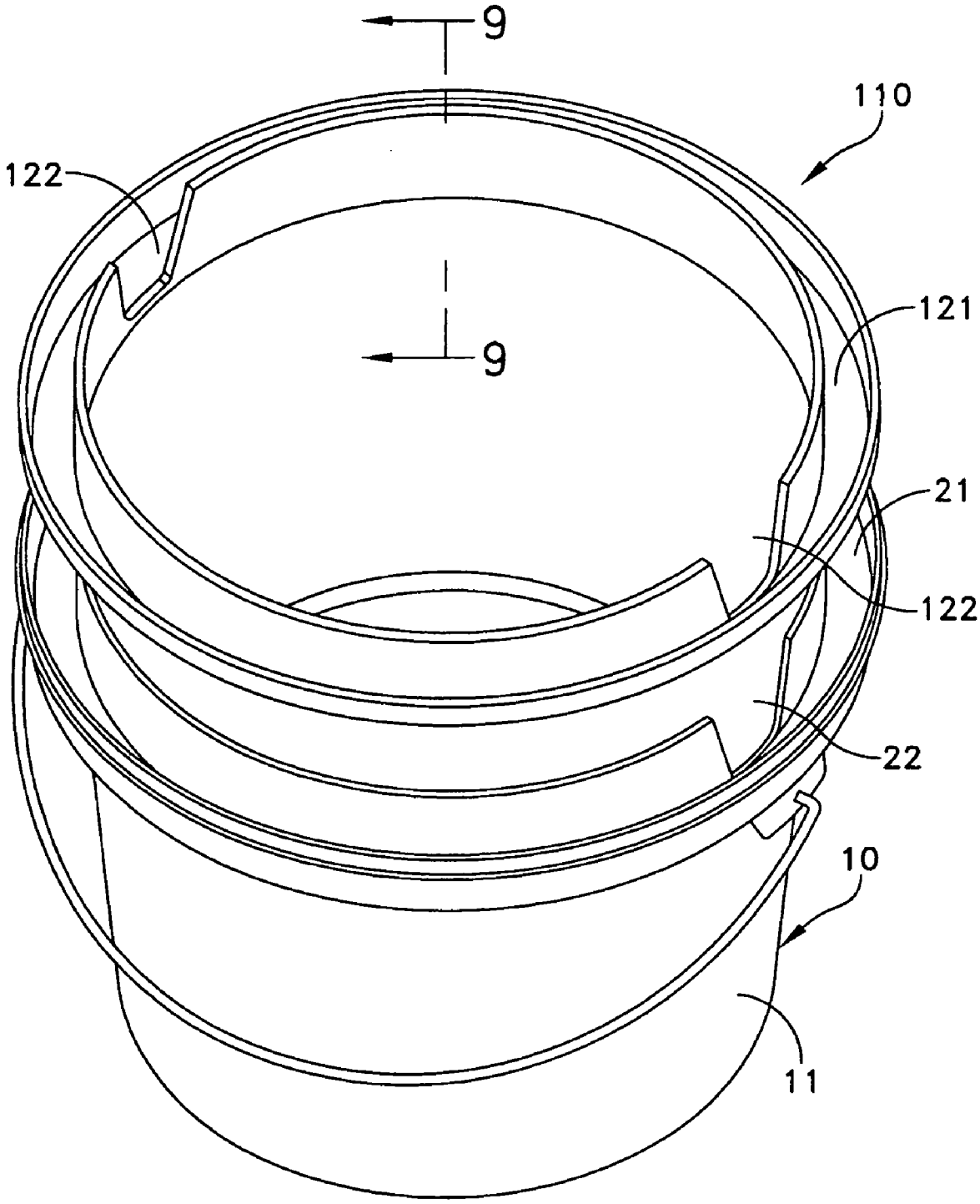
FIG. 8 is a perspective view of a partially assembled painting apparatus with the paint bucket of FIG. 2 and liner of FIG. 3.
Figure 9:
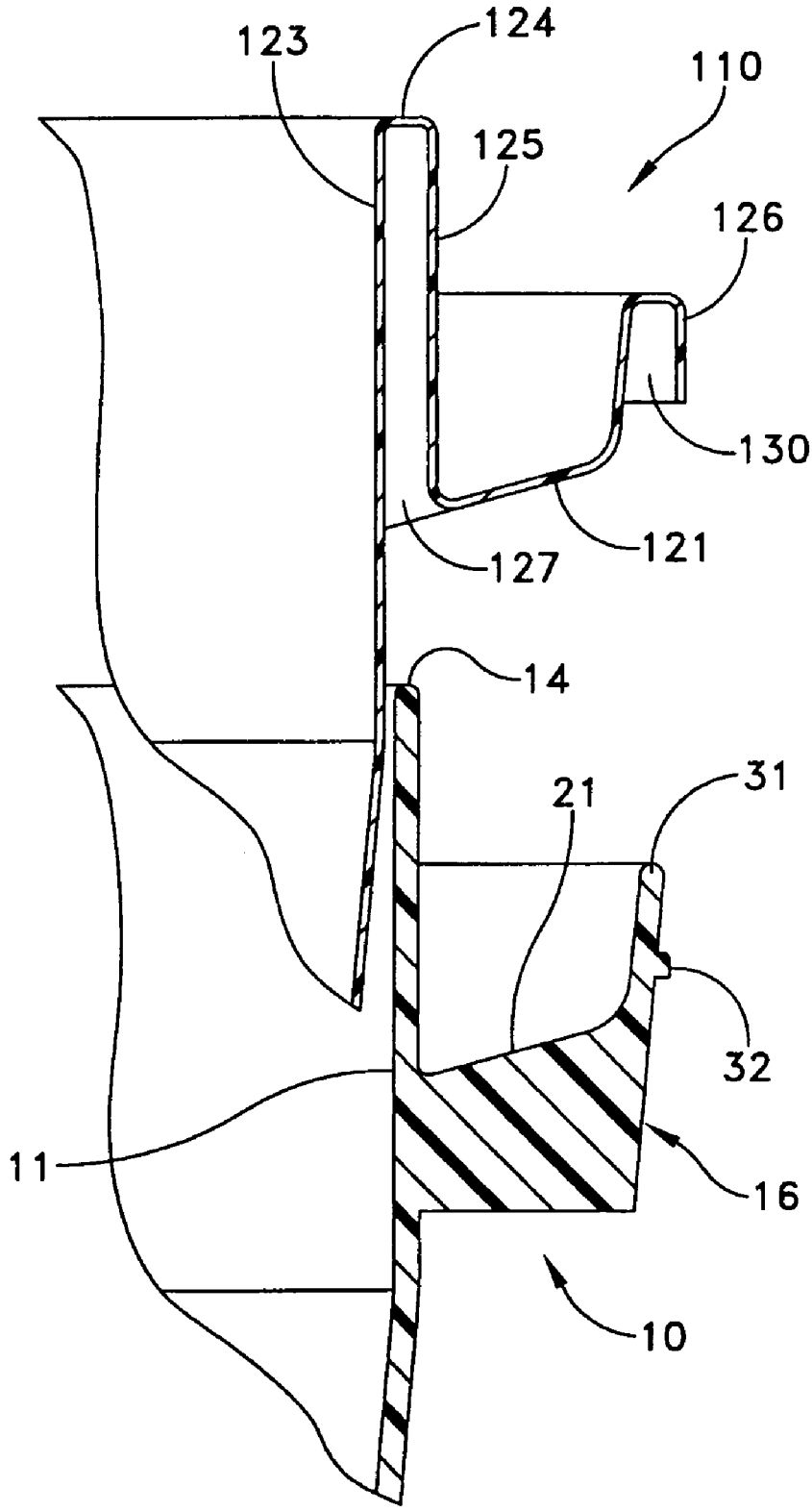
FIG. 9 is an enlarged partial sectional view taken along lines 9-9 in FIG. 8 depicting the relationship between the paint bucket and liner during insertion of the liner into the bucket.

FIGS. 8 and 9 disclose a paint bucket 10 with a partially inserted liner 110. The liner 110 is angularly aligned so that the drain notches 122 will register with the drain notches 22 in the paint bucket 10. The extension 123 and portions 124 and 125 form an annular recess or channel 127 that registers with that portion of the side wall 11 adjacent the top rim 14. The conical section 121 will register with the floor 21 of the paint bucket 10. The inverted U-shaped portion 126 forms an annular recess or channel 130 that registers with an outer edge 31 above a circumferentially radially extending shoulder 32 on the outer edge 31.

Figure 10:
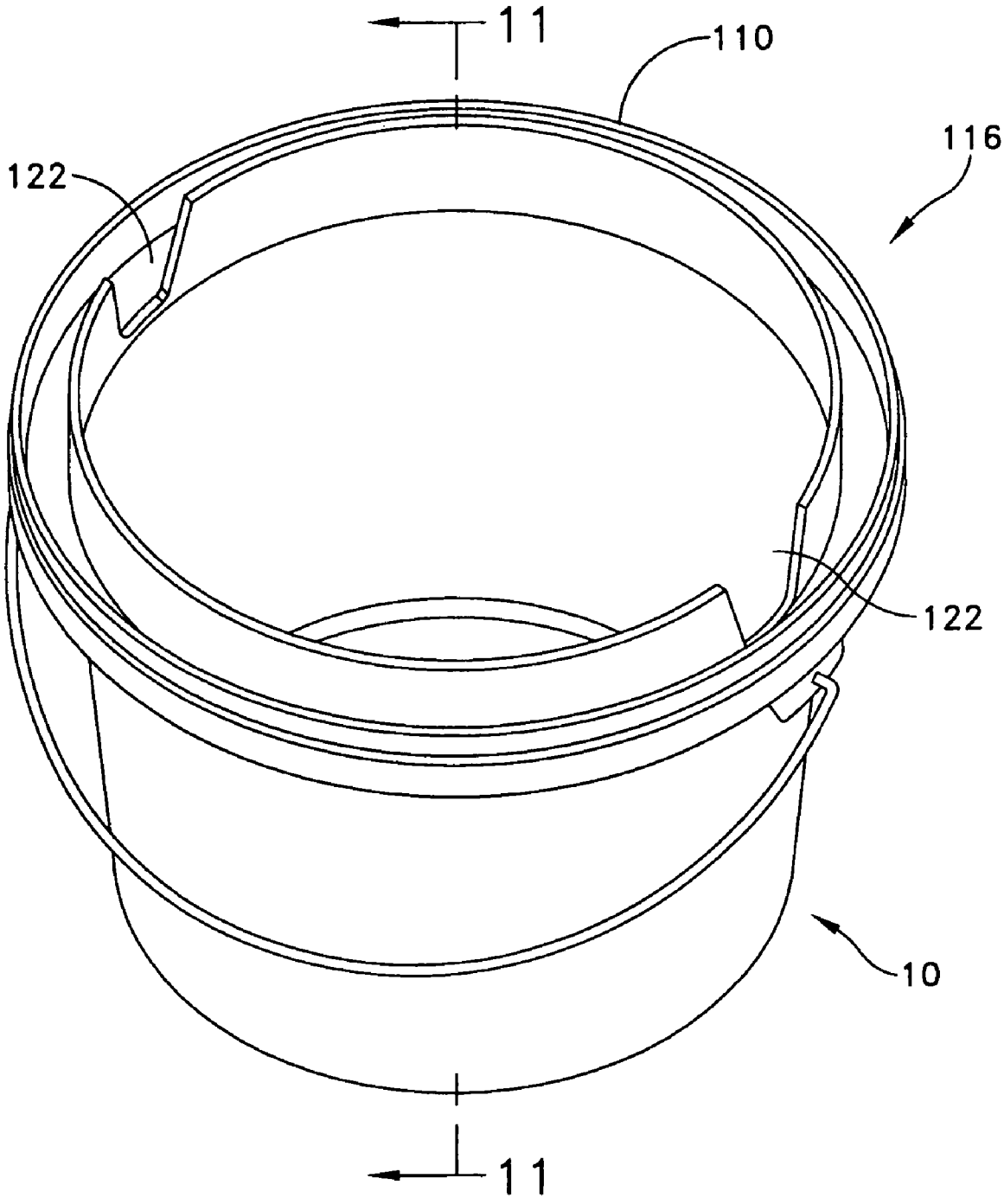
FIG. 10 is a perspective view of the painting apparatus of FIG. 1 assembled for use.
Figures 11, 12:
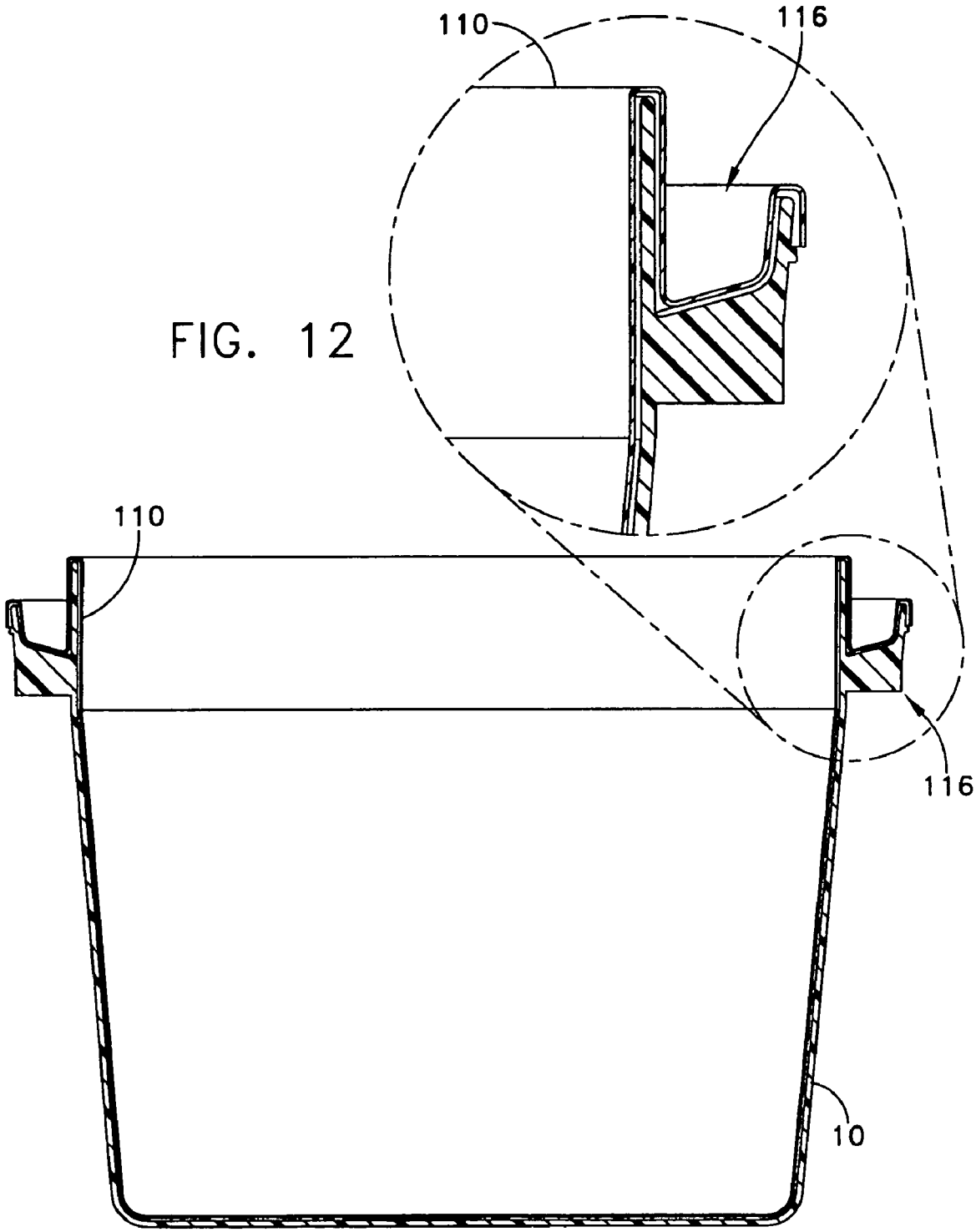
FIGS. 11 and 12 are cross sectional views of the assembled paint bucket and liner taken along lines 11-11 of FIG. 10.

When both the liner and bucket are fully assembled as shown in FIGS. 10 through 12, the painter has two options. First, because the gutter 116 is reasonably wide and the drain notches 122 are readily accessible because the drain notches are opened at the top, even the liner 110 can be readily cleaned. Alternatively, as the liner 110 overlies all the surfaces of the paint bucket it can merely be removed for disposal leaving no requirement for cleaning this apparatus.

It will now be apparent that multiple paint buckets 10 can be nested for storage in a stack. Such stacking occurs without any surface-to-surface contact, so the top paint bucket in a stack is easily removed from the stack.

Figure 13:
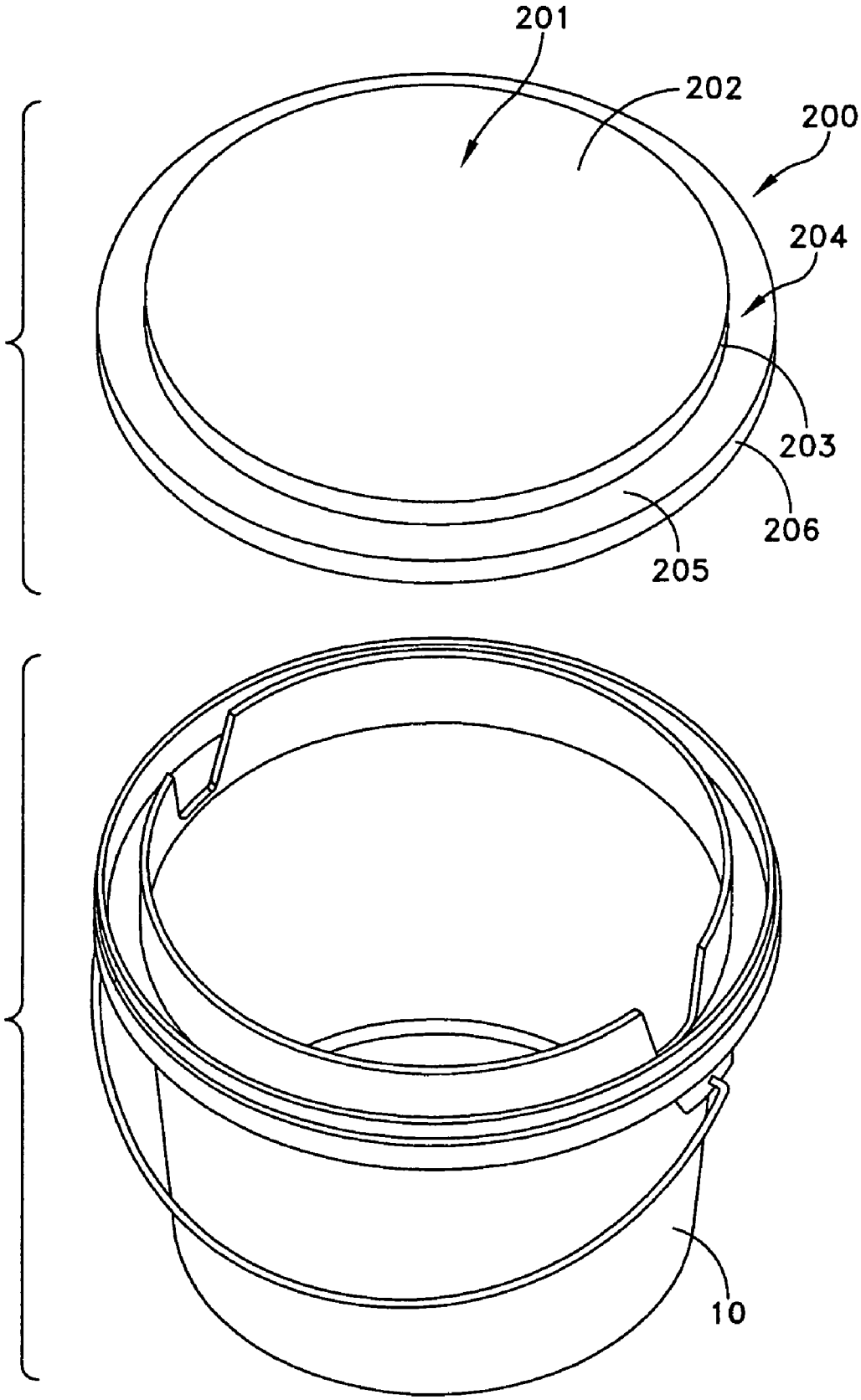
FIG. 13 is a exploded perspective view showing a paint bucket and cover.
Figure 14:
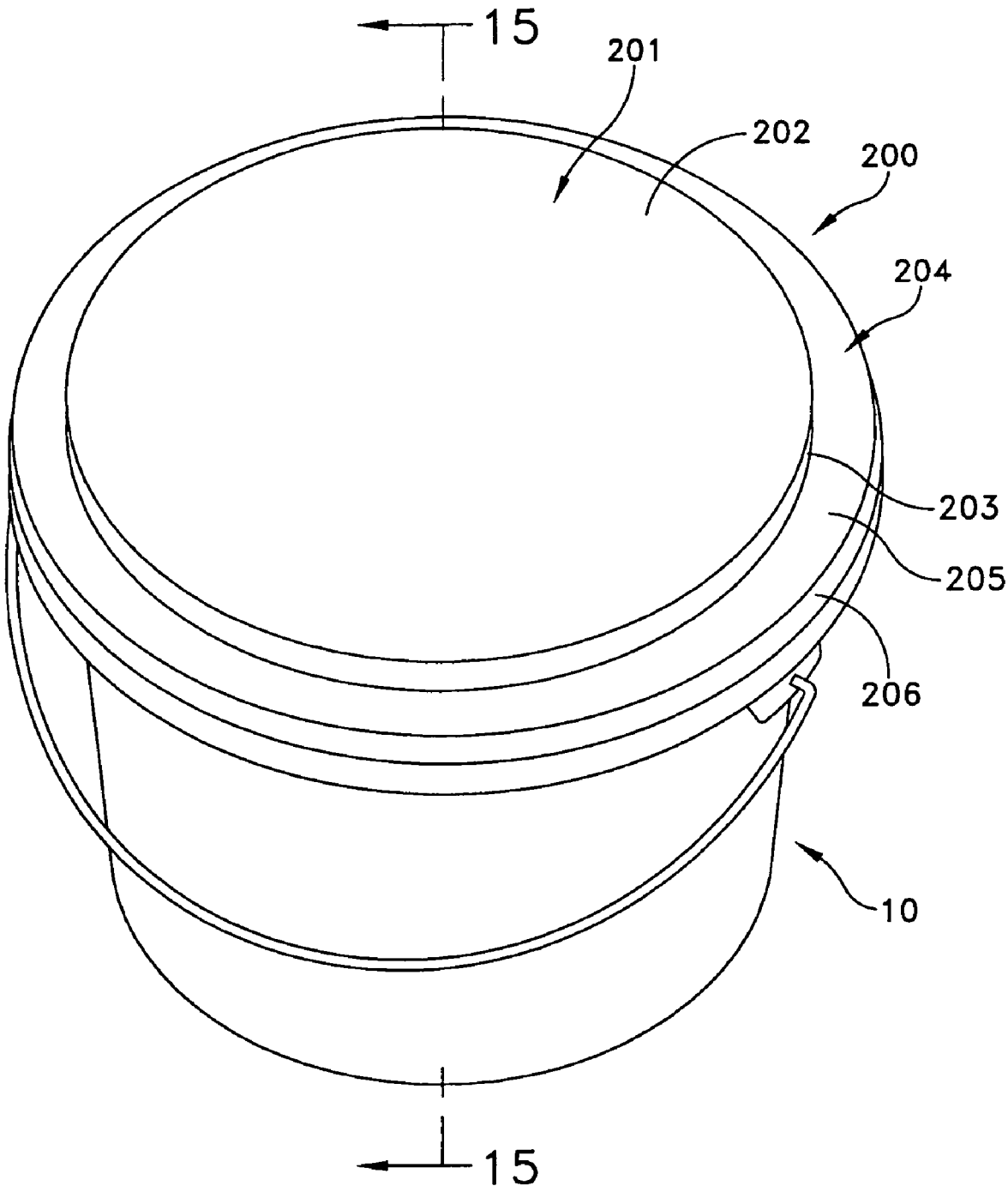
FIG. 14 is a perspective view of the paint bucket with the cover of FIG. 13 attached.
Figure 15:
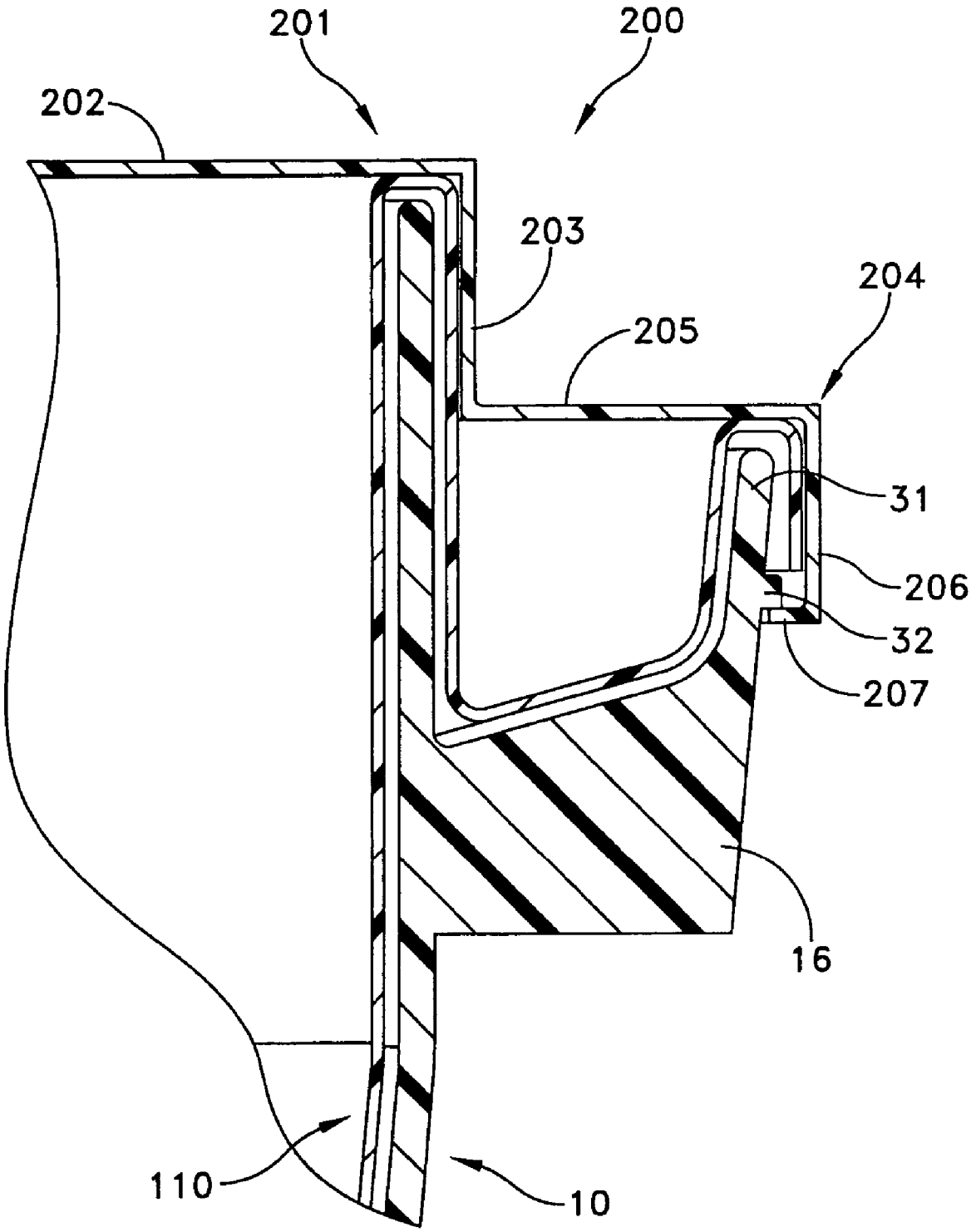
FIG. 15 is a cross sectional view taken along lines 15-15 of FIG. 14 with the cover attached to the combination of the bucket and the liner.

FIGS. 13 through 15 depict an embodiment of this invention with the added feature of providing a closure to the paint bucket 10 and/or liner 110 for temporary storage of the paint. In accordance with this embodiment, a cover 200 has a central raised portion 201 with a planar body 202 and a peripheral cylindrical body 203. The cover 200 additionally includes an annular portion 204 with an annular, planar body 205 extending from the bottom of the cylindrical body 203 and including a depending cylindrical body 206. The free end of the cylindrical body 206 terminates in a radially extending return or clip portion 207. As particularly shown in FIG. 15, the inner diameter of the depending cylindrical body 203 is selected so the inner portion of the cylindrical body 203 abuts the liner 123 or the pail wall 23.

As specifically shown in FIG. 5, the annular, planar body 205 has a radial dimension such that the depending cylindrical body 206 overlies the gutter 16 formed by the paint bucket 10 and the gutter structure 116 formed by the liner 110, if present. The return portion 207 provides a locking function. Specifically, there is sufficient flexibility in the cover 200 to allow the cylindrical body 206 to expand and snap over the radial shoulder 32 on the paint bucket 10. Thus, the cover 200 can be used to close the paint bucket 10 with or without the liner 110 being installed. This provides a temporary seal to preserve the paint during periods when an individual is not painting actively as, for example, during a lunch hour or during a time when the painter is diverted to other work.

The paint bucket 10, as disclosed in FIGS. 1 through 4 has several advantages when used alone. The gutter 16 and drain notches 22 catch excess paint drippings and return them to the interior of the container rather than fall on a supporting surface. This gutter 16 will not fill and spill over the edge allowing it to better protect the area underneath the container during use. The container has a wiping lip that is higher than the gutter outer edge 20 allowing the user to scrape excess paint across the rim 14 with the majority of the paint flowing directly into the interior 15, so the gutter 16 catches only minimal amounts of paint. The paint bucket 10 can be reusable because the design of the gutter 16 and open drain notches 22 for complete cleaning. As a molded integral unit, the paint bucket 10 is subject to inexpensive manufacturing so a painter will be able to afford a collection of these paint buckets and to store them in a minimal volume because they are stackable.

If a painter does not wish to clean the paint bucket 10 for reasons of overall operating efficiency or other reasons, the painter can use the liner 110 with the paint bucket 10. The liner covers all the interior surfaces, gutter surfaces and notch surfaces of the paint bucket 10. Inserting the liner does not detract from the other advantages of the dripless paint bucket. The painter has the option of cleaning the liner or merely disposing of the liner 110. The liner 110 can be constructed of a thin material because the paint bucket supports the liner fully. The thinner liner allows multiple liners to be packaged in a compact form and to be produced at reduced costs.

Other advantages of the paint bucket 10 and liner 110 can be seen realized by the use of the cover 200. As described, the cover 200 can seal the paint bucket 10 with or without a liner 110. The cover 200 allows the painter to interrupt painting without continually exposing paint to air and thereby simulates the resealing of a paint can with partial contents.

This invention has been disclosed in terms of certain embodiments. That is, the first embodiment of this invention was in the form of apparatus for painting, such as the bucket 10 and liner 110 that are described. More generically, this invention is adapted for use with any liquid that an individual might wish to pour or to withdraw from a container by means of a tool or utensil, such as a brush. For example, the structure of the bucket and liner are readily adapted to use in food preparation wherein the individual might wish to withdraw a basting sauce from a container with a basting brush with only a minimal chance that the sauce will drip onto an underyling table or tablecloth. As will also be apparent, if the liquid is poured from the container, any drips that might fall from the rim as the container is moved from a pouring orientation to an upright orientation will fall into the gutter. Thus, it will be apparent that many modifications can be made to the disclosed apparatus to adapt it to diverse uses without departing from the spirit and scope of this invention.

What is claimed and desired to be secured by Letters Patent of the United States is:

1. A disposable liner for use in a paint bucket that includes a closed bottom and a side wall extending to a top rim thereof, a continuous circumferential peripheral bucket gutter formed integrally with and exteriorly of the side wall at a location below the top rim and including a gutter floor, an outer wall and a plurality of angularly spaced bucket drain notches through the side wall extending from the top rim toward the gutter floor, said liner comprising:

A) a molded liner container having a closed bottom and a side wall and adapted to be inserted into the bucket container for support thereby for receiving paint therein, B) an integrally molded continuous circumferential peripheral liner gutter including a side wall extension that forms a first inverted channel for overlying the bucket side wall above the bucket gutter floor, an outer inverted channel for overlying the bucket outer wall and an intermediate floor for overlying the bucket gutter floor, and C) at least one integrally molded liner drain notch extending through said first inverted channel between a liner top rim and a liner gutter floor, said at least one liner drain notch being adapted to conform to and to be in register with one of the at least one bucket drain notches whereby said liner drains paint that accumulates in said liner gutter through said at least one liner notch into said liner container and said liner being adapted to isolate the paint therein from surfaces of the paint bucket.

2. A disposable liner as recited in claim 1 wherein said liner floor slopes down to said liner drain notch from a position peripherally remote from said liner drain notch whereby material in said liner gutter drains to said liner drain notch.

3. A disposable liner as recited in claim 1 wherein said liner side wall tapers.

4. An assembly for facilitating painting comprising:

A. a paint bucket comprising:

i) a bucket container having a closed bottom and a side wall extending to a top rim thereof, ii) a continuous peripheral bucket gutter formed integrally with and exteriorly of said side wall at a location below the top rim, said bucket gutter having an outer wall and a gutter floor, iii. at least one bucket drain notch through the side wall extending from the top rim toward the gutter floor, and iv. a handle pivotally attached to the bucket side wall below said bucket gutter; and B. a disposable liner in said paint bucket container and comprising:

i. a molded liner container having a closed bottom and a side wall and adapted to be inserted into the paint bucket container to be supported thereby and to receive paint therein, ii. an integrally molded continuous peripheral liner gutter including a side wall extension that forms a first inverted channel for overlying the bucket side wall above the bucket gutter floor, an outer inverted chancel for overlying the bucket outer wall and an intermediate liner gutter floor for overlying the bucket gutter floor, and iii. at least one integrally formed liner drain notch extending through said first inverted channel from said liner top rim to said liner gutter floor, each of said at least one liner drain notch being conforming to and registering with one of the at least one bucket drain notches whereby paint in said liner gutter drains through said at least one liner drain notch to said liner container and said liner isolates the paint therein from surfaces of said paint bucket.

5. A painting facilitating assembly as recited in claim 4 wherein each of said bucket and liner floors slopes down to said bucket and liner drain notches respectively from positions peripherally remote thereto whereby material in said liner gutter drains to said liner drain notch.

6. A painting facilitating assembly as recited in claim 4 wherein said bucket and liner side walls taper.

7. A painting facility assembly as recited in claim 4 including a cover for overlying said open top and said gutter.

* * * * *